US005802822A

United States Patent [19]

Holzhauser

[11] Patent Number: 5,802,822

[45] Date of Patent: Sep. 8, 1998

[54] EQUESTRIAN RIDING AID

[76] Inventor: Lynne M. Holzhauser, 52-97 79th St., Elmhurst, N.Y. 11373

[21] Appl. No.: 747,880

[22] Filed: Nov. 13, 1996

[51] Int. Cl.[6] ..... B68C 1/16

[52] U.S. Cl. ..... 54/46.1; 54/48

[58] Field of Search ..... 54/46.1, 48; 119/770, 119/857; 182/6; 482/124

[56] References Cited

U.S. PATENT DOCUMENTS 866,495 9/1907 Marks ..... 482/124

2,109,209 2/1938 Douglas ..... 54/48 X 5,062,642 11/1991 Berry et al. ..... 482/124 X 5,336,151 8/1994 Van Ballegooie ..... 482/124

*Primary Examiner*—Robert P. Swiatek

*Attorney, Agent, or Firm*—Pennie Edmonds LLP

[57] ABSTRACT

An equestrian riding aid having first and second tensioning members, for providing tension between the rider's hips and heels and extending from the rider's right and left hips, respectively, to the rider's right and left heels, wherein each tensioning member comprises an elastic extension attached to a heel hoop; and a positioning member for positioning the tensioning members adjacent the rider's hips.

6 Claims, 4 Drawing Sheets

EQUESTRIAN RIDING AID

BACKGROUND

The present invention relates generally to a device for assisting a person to ride a horse correctly and more specifically to a device which provides resistance against movement of the legs and feet relative to the rider's hips in order to guide the rider's body while riding a horse.

There is more to horseback riding than simply sitting on a horse. A rider must make certain prescribed movements and assume certain prescribed positions in order to ride a horse correctly. These movements and positions must be learned by the rider's muscles. Learning these movements and positions requires the rider to become aware of his body in a way that he may not have been previously.

SUMMARY OF THE INVENTION

The equestrian riding aid of the present invention assists a rider in riding a horse correctly and includes an elastic means for elastically connecting a rider's right and left hips to the rider's right and left heels respectively, and an attachment means for attaching the elastic means to the rider's body.

More specifically, the equestrian riding aid of the present invention generally comprises first and second tensioning members, for providing tension between the rider's hips and heels and extending from the rider's right and left hips, respectively, to the rider's right and left heels, wherein each tensioning member comprises an elastic extension attached to a heel hoop; and a positioning member for positioning the tensioning members adjacent the rider's hips.

BRIEF DESCRIPTION OF THE DRAWINGS

Reference is next made to a brief description of the drawings, which are intended to illustrate a first embodiment of the equestrian riding aid according to the present invention and a number of alternative embodiments. The drawings and detailed description which follow are intended to be merely illustrative, and are not intended to limit the scope of the invention as set forth in the appended claims.

DETAILED DESCRIPTION OF THE EQUESTRIAN RIDING AID

Figure 1:
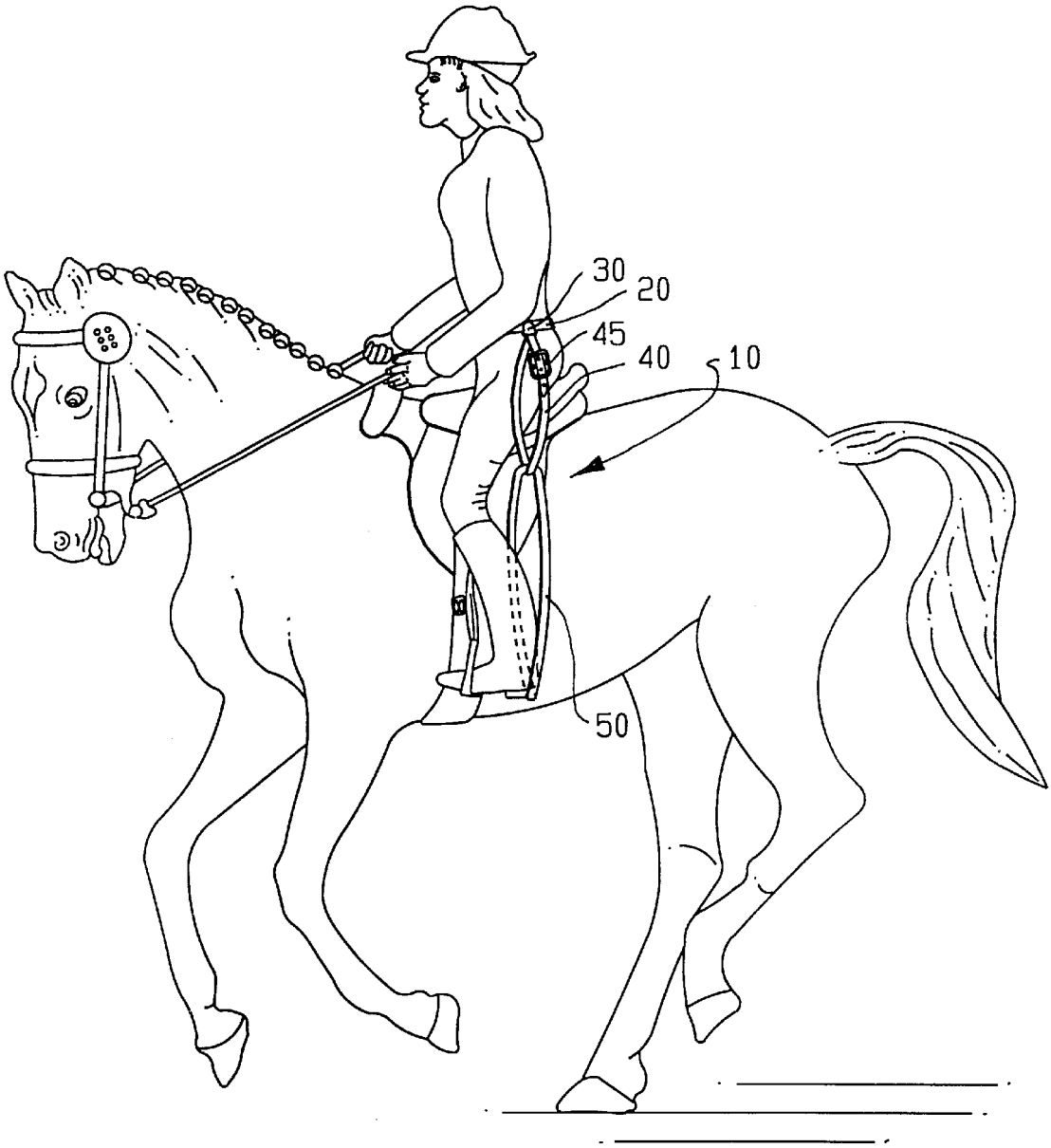
FIG. 1 is a perspective view of a first embodiment of a rider wearing the equestrian riding aid according to the present invention.
Figure 2:
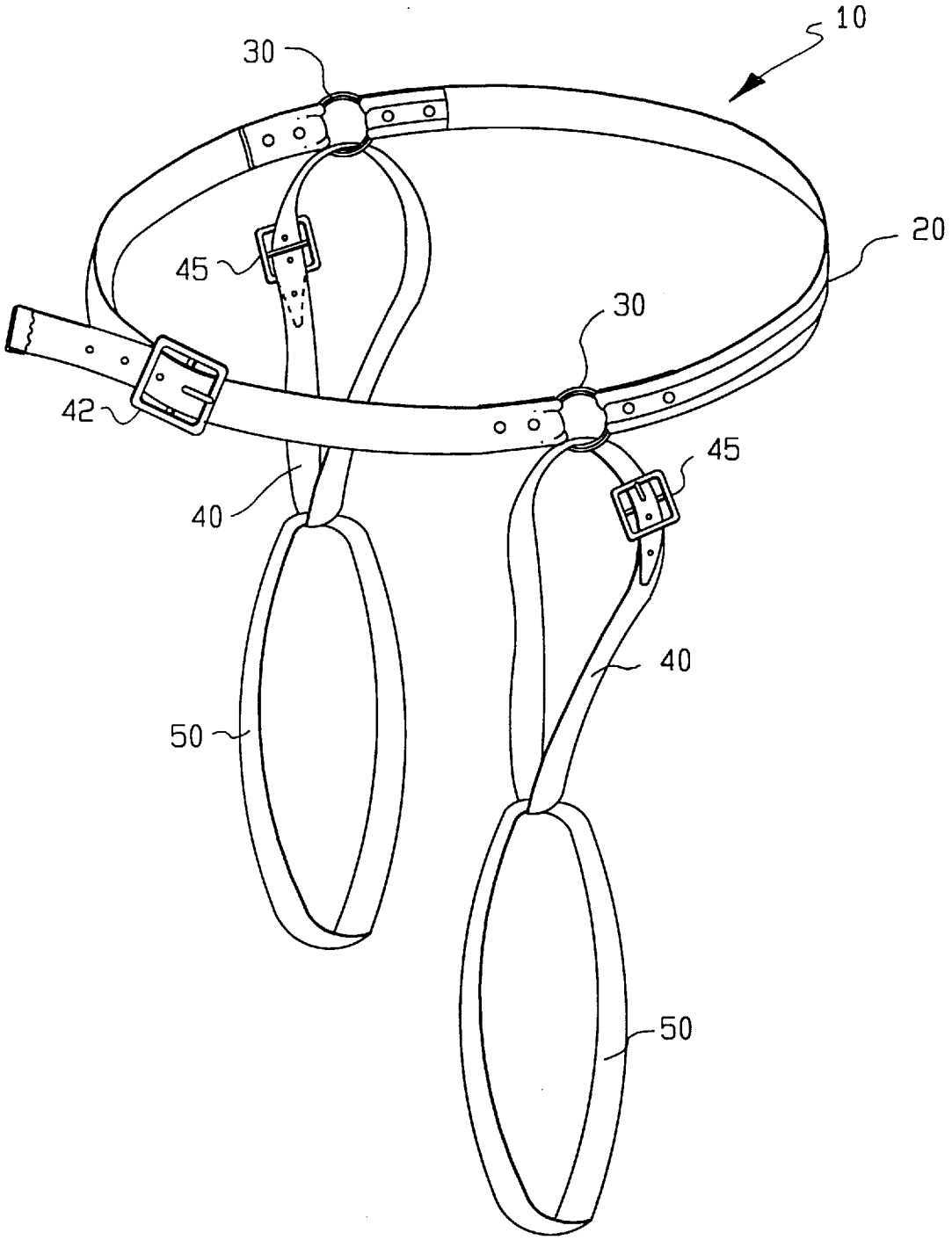
FIG. 2 is a perspective view of the first embodiment of the equestrian riding aid.

Referring more particularly to FIGS. 1 and 2, an equestrian riding aid 10 according to a first embodiment of the present invention is shown. This equestrian riding aid 10 comprises a belt 20, two hip rings 30 attached to the belt 20, two elastic extensions 40 attached to the hip rings 30, and two heel hoops 50 attached to the elastic extensions 40. Only one of the hip rings 30, the elastic extensions 40 and the heel hoops 50 is shown in FIG. 1. As shown in FIG. 2, the aid 10 is symmetric.

As shown in FIG. 1, the belt 20 is worn around the rider's hips. The belt may be made of any material that will withstand normal wear. One example of such a material is leather. In addition, this material may or may not have elastic properties. As shown in FIG. 2, the belt 20 is adjustable by means of belt buckle 42 so that riders of varying girths may use the aid 10.

Two hip rings 30 are attached to the belt 20, and the rider adjusts the belt 20 so that each hip ring 30 sits at each of his hipbones. The hip rings 30 are made of metal, and they are circular. However, they may be made of alternative materials such as plastic or rubber. Any material may be used to make the hip rings 30 as long as the rider can feel them on his hipbones when the belt 20 is worn around his hips. In addition, the hip rings 30 may be any number of alternative shapes, such as, but not limited to, oval, triangular or rectangular.

Figure 3:
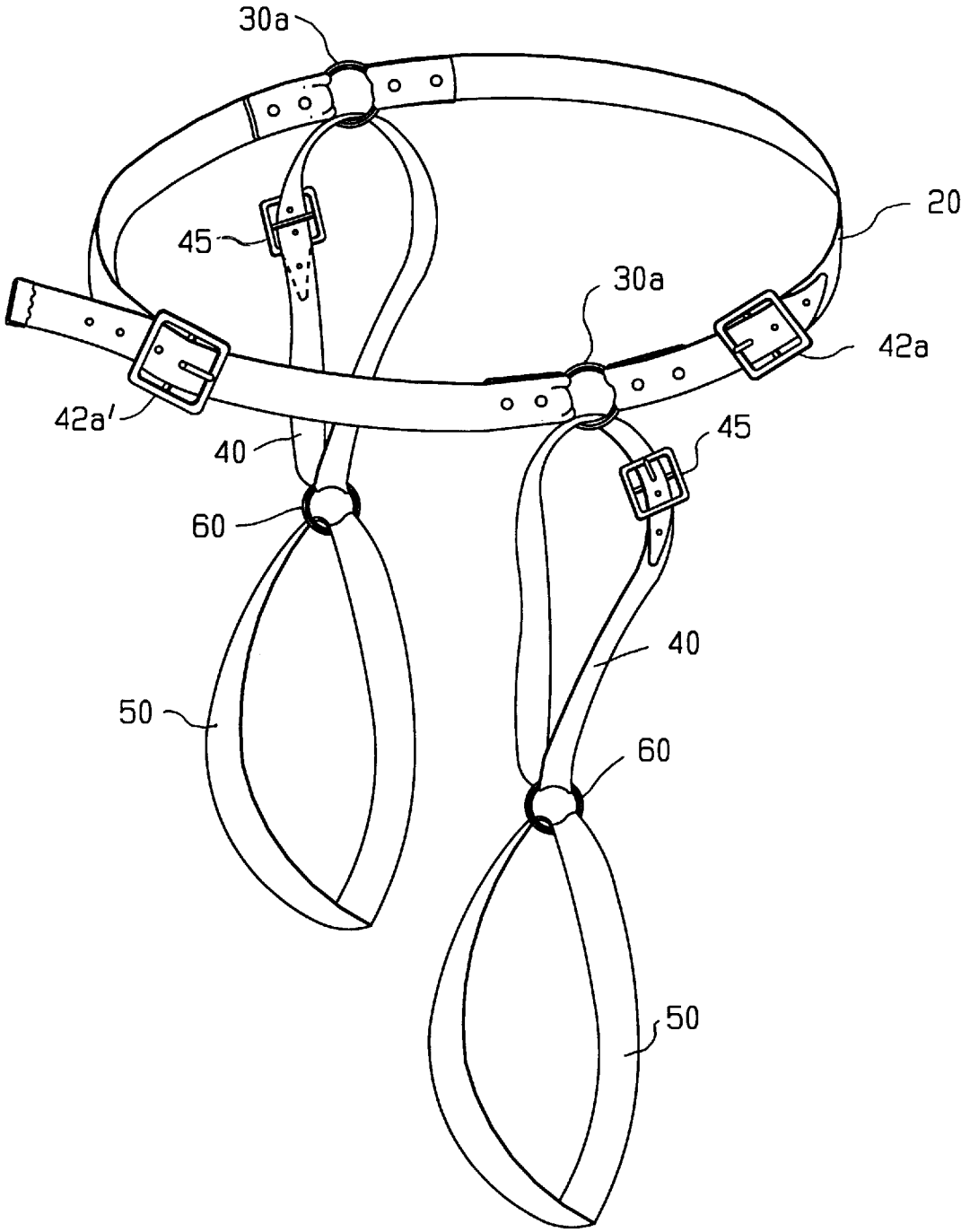
FIG. 3 is a perspective view of a second embodiment of the equestrian riding aid with two belt adjustment members and two connection rings.
Figure 4:
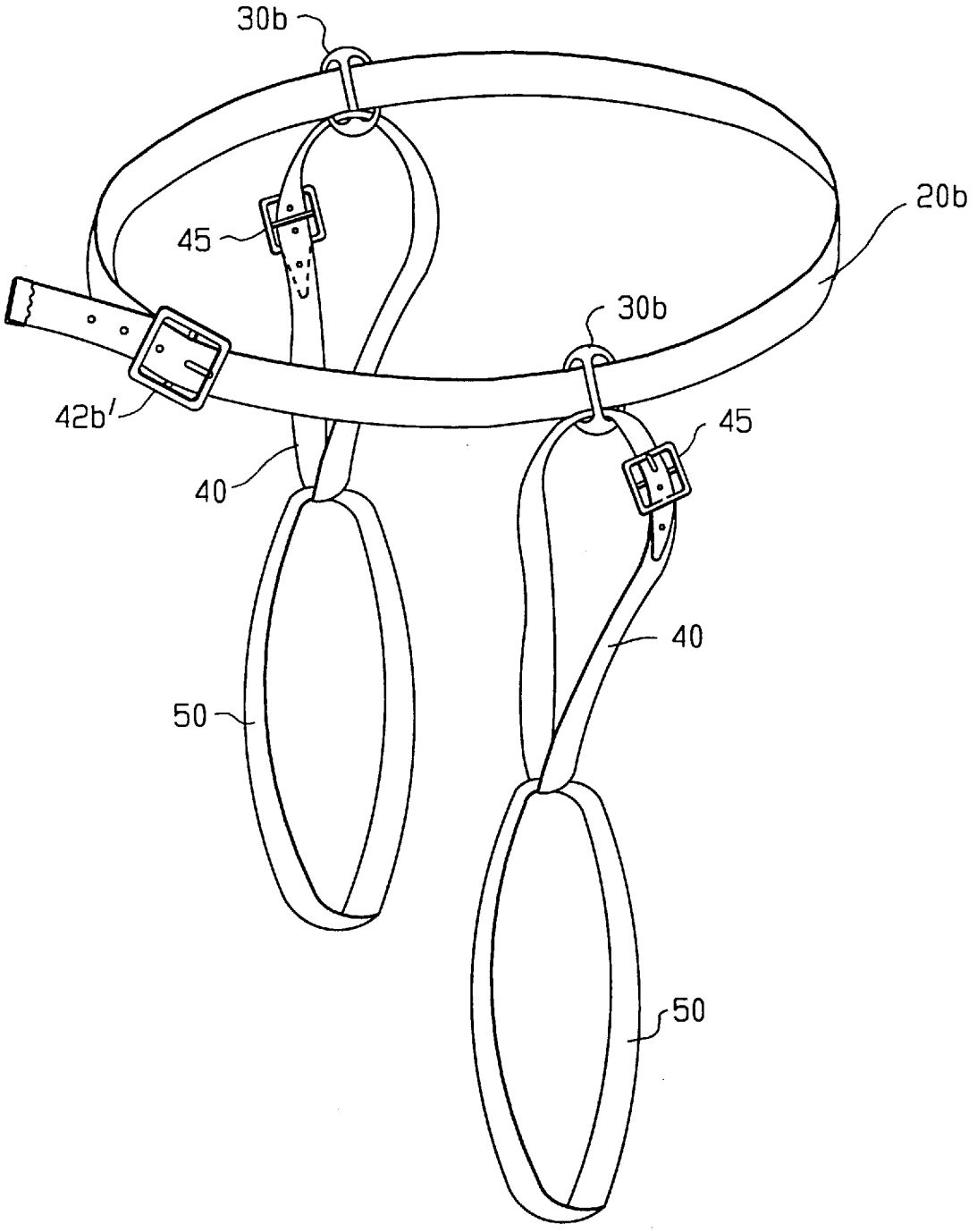
FIG. 4 is a perspective view of a third embodiment of the equestrian riding aid with adjustable hip rings.

In order to facilitate adjustment of the belt 20, the second embodiment of the present invention has two adjustment mechanisms as shown in FIG. 3. In this embodiment, one belt buckle 42*a* is located at the back of the rider between the hip rings 30*a* and another belt buckle 42*a*' is located at the front of the rider, also between the hip rings 30*a*. Other appropriate adjustment mechanisms also may be used. In the third embodiment shown in FIG. 4, the hip rings 30*b* may be adjusted individually relative to the belt 20*b* so that they sit at the rider's hipbones. Because of the adjustment feature of the hip rings 30*b*, this embodiment only requires one belt buckle 42*b*, which may be located between the hip rings 30*b* either at the front or the back of the rider.

As shown in FIGS. 1 and 2, the heel hoops 50 are connected to the elastic extensions 40, which are in turn attached to the hip rings 30. The rider places his heels in the heel hoops 50 when using the aid 10. Adjustment buckles 45 allow the rider to adjust the elastic extensions 40. Alternative adjustment means also may be incorporated into alternative embodiments of the present invention. Because the elastic extensions 40 are adjustable, users of varying heights and lower body dimensions may use the aid 10. The elastic extensions 40 also may be adjusted to achieve different degrees of tension. New riders may want to shorten the elastic extensions 40 so that the heel hoops 50 fit tightly around their heels and will not inadvertently slip off. As a rider becomes more experienced, he may not require as much tension or guidance as he did when he was a novice. Therefore, he may lengthen the elastic extensions 40 accordingly. Alternatively, an adjustment mechanism may be provided on the heel hoops 50 instead of on the elastic extensions 40 or adjustment mechanisms may be provided on both the elastic extensions 40 and the heel hoops 50.

In the first embodiment, the elastic extensions 40 and the heel hoops 50 are made of an elastic rubber. However, alternative materials such as leather may be used for either or both elements. The material chosen to make the elastic extensions 40 and the heel hoops 50 must be of sufficient flexibility to allow the rider a certain amount of freedom to rotate his feet with respect to his hips.

Although this movement may not be required while riding a horse, this freedom will contribute to the rider's comfort while resting on the horse. Adjustment of the elastic extensions 40 and the heel hoops 50 may be effected either by adjustment means such as buckles, by the elastic nature of the materials composing either or both elements or a combination of both. In the second embodiment shown in FIG. 3, connection rings 60 connect the elastic extensions 40 to the heel hoops 50. The connection rings 60 are made of metal, and they are circular. However, they may be made of any material and comprise any shape suitable for providing a connection between the elastic extensions 40 and the heel hoops 50. The connection rings 60 contribute to the rotational freedom of the rider's feet.

The elastic extensions 40 in combination with the heel hoops 50 create two lines of energy between the right hip and the right heel and between the left hip and the left heel. The tension in these lines of energy increases as the rider pushes his heels down and decreases as he lifts his heels. This tension and its variations in the lines of energy focus the rider's attention on the movement of his legs and feet relative to his hips, thereby assisting him in emulating the movements required to ride a horse correctly. A rider also must be aware of his hips and his feet individually. Feeling the hip rings 30 at his hipbones focuses the rider's attention on his hips and feeling the heel hoops 50 on his heels focuses the rider's attention on hi's feet.

Inexperienced riders often have difficulty pushing their heels down while riding because this is not a movement that occurs naturally in other activities or contexts. During a canter, for example, the rider must drop down onto the horse, not by leaning forward or putting weight on the stirrups, but by dropping his weight into his heels. As explained above, the resistance or tension provided by the aid 10 increases as the rider pushes his heels down and decreases as he lifts his heels. By providing resistance which varies depending on the movement of the rider's legs and feet, the aid 10 isolates the muscles required for moving the legs and feet correctly and also indicates to the rider whether he is moving his legs and feet and whether he is moving them correctly. In addition, the rider's bottom must stay on the horse. By pushing the heels against the heel hoops 50, the elastic extensions 40 pull against the hips, helping the rider maintain his backside on the horse.

Although horseback riding is an active sport, a rider must also learn to relax, which is another difficulty for some riders. While concentrating on the correct lower body movements, an inexperienced rider tends to tense his upper body, especially his shoulders. By focusing a rider's attention on his lower body, the aid 10 helps a rider relax the parts of his body that are not required to move. In addition, by having an elastic connection between the hips and feet on both sides of the body, the aid 10 guides the rider in moving both legs symmetrically, thereby bringing a sense of balance to the rider.

As soon as the rider's muscles learn the correct movements and positions, the rider will no longer need the aid 10 in order to ride a horse correctly.

What is claimed is:

1. An equestrian riding aid for guiding a rider's lower body while riding a horse, comprising:

first and second tensioning members, for providing tension between the rider's hips and heels and extendable from the rider's right and left hips, respectively, to the rider's right and left heels, wherein each tensioning member comprises an elastic extension attached to a heel hoop; and an adjustable belt comprising two buckles for positioning the tensioning members adjacent the rider's hips.

2. The equestrian riding aid of claim 1 which further comprises first and second hip rings for respectively connecting the first and second tensioning members to the positioning member.

3. The equestrian riding aid of claim 2 wherein the positioning member is adjustable such that it can fit snugly around the rider's hips and such that the hip rings can be placed on the rider's hipbones.

4. The equestrian riding aid of claim 3 wherein the heel hoops can engage the rider's heels and each tensioning member includes an adjustment member for adjusting the length of the tensioning member.

5. The equestrian riding aid of claim 4 wherein each adjustment member is a belt.

6. An equestrian riding aid for guiding a rider's lower body while riding a horse, comprising:

first and second tensioning members, for providing tension between the rider's hips and heels, extendable from the rider's right and left hips, respectively, to the rider's right and left heels, wherein each tensioning member includes an elastic extension connected to a heel hoop by a connection ring; and a belt, having two adjustment members, for positioning the tensioning members adjacent the rider's hips.

* * * * *